United States Patent [19]

Watkins

[11] 4,161,960

[45] Jul. 24, 1979

[54] HIGH AND LOW TUBING PRESSURE ACTUATED WELL SAFETY VALVE

[75] Inventor: Fred E. Watkins, Houston, Tex.

[73] Assignee: Camco, Incorporated, Houston, Tex.

[21] Appl. No.: 880,532

[22] Filed: Feb. 23, 1978

[51] Int. Cl.[2] ..... F16K 17/00

[52] U.S. Cl. ..... 137/458; 137/461; 137/463; 137/466; 166/323

[58] Field of Search ..... 137/458, 461, 463, 464, 137/466; 166/319, 323, 324

[56] References Cited

U.S. PATENT DOCUMENTS

| | | | |
|---|---|---|---|
| 2,733,729 | 2/1956 | Wolfe | 137/458 |
| 3,765,443 | 10/1973 | Young | 166/323 X |

*Primary Examiner*—Harold W. Weakley

*Attorney, Agent, or Firm*—Fulbright & Jaworski

[57] ABSTRACT

A well safety valve adapted to be positioned in a well tubing and close on either a predetermined high tubing pressure or a predetermined low tubing pressure. The valve closure member in the valve body moves between an open and closed position in response to longitudinal movement of a tubular member. The tubular member has an open bore for alignment with the bore of the well tubing to provide straight through flow through the safety valve. In addition, the tubular member has a plurality of telescoping sections and releasable and resettable locking means normally securing the plurality of sections together. A predetermined high tubing pressure or a predetermined low tubing pressure acting on the tubular member causes the valve to close.

4 Claims, 9 Drawing Figures

48
44

46
34
70
40
36
24
50

36
64
60
42
66
68
62
38
52

24
30
38
20
26
32
22
54
39
28
58
56

HIGH AND LOW TUBING PRESSURE ACTUATED WELL SAFETY VALVE

BACKGROUND OF THE INVENTION

Generally, it is old to provide a subsurface safety valve system having a plurality of valves, one of which opens on high tubing pressure and the other which closes on low tubing pressure. For example, see U.S. Pat. Nos. 3,749,119 and 3,672,397.The present invention is directed to an improved safety valve having a single valve closure member which is actuated by a tubular member for providing straight through flow. The tubular member is acted upon by an abnormal or predetermined high tubing pressure or an abnormal or predetermined low tubing pressure to actuate the valve closure member to a closed position.

SUMMARY

The present invention is directed to a well safety valve adapted to be positioned in a well tubing and closed on either a predetermined high tubing pressure or a predetermined low tubing pressure for protecting the well against abnormal tubing pressures.

A still further object of the present invention is the provision of a well safety valve having a body and a valve closure member moving between open and closed positions in which a tubular member is longitudinally movable in the body for controlling the movement of the valve closure member. The tubular member provides a straight through fluid flow in the valve. The tubular member includes a plurality of telescoping sections which are releasably locked together.

Yet a still further object of the present invention is the provision of a well safety valve in which a longitudinally movable tubular member controls the movement of a valve closure member and the tubular member is normally biased in a direction to open the valve member. A predetermined high tubing pressure acting on the tubular member closes the valve. The tubular member includes a plurality of telescoping sections having releasable locking means normally locking the sections together. The lowest section is biased in a direction for allowing the closure of the valve member when the lowest section is unlocked from the other sections.

Yet a still further object of the present invention is the provision of a stop shoulder in the path of movement of the lower telescoping section of the tubular member in the opening direction for actuating the release of the locking means when the tubing pressure reaches a predetermined value.

The high-low tubing actuated safety valve of the present invention is resettable such as by suitably pressuring the well tubing from the well surface or by equalizing across the valve.

Other and further objects, features and advantages will be readily apparent from the following description of a presently preferred embodiment of the invention, given for the purpose of disclosure and taken in conjunction with the accompanying drawings.

DESCRIPTION OF THE PREFERRED EMBODIMENT

While the present improvement in a well safety valve will be shown, for purposes of illustration only, as incorporated in a flapper-type well safety valve, it will be understood that the present invention may be used in other types of well safety valves.

Figure 1:
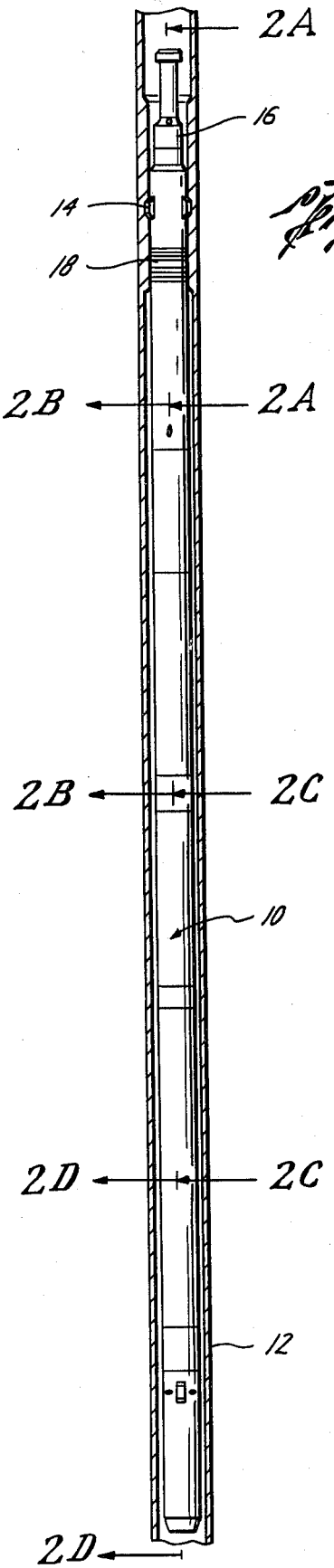
FIG. 1 is an elevational drawing, partly in cross section, illustrating the safety valve of the present invention in use in a portion of a well tubing.
Figure 2A:
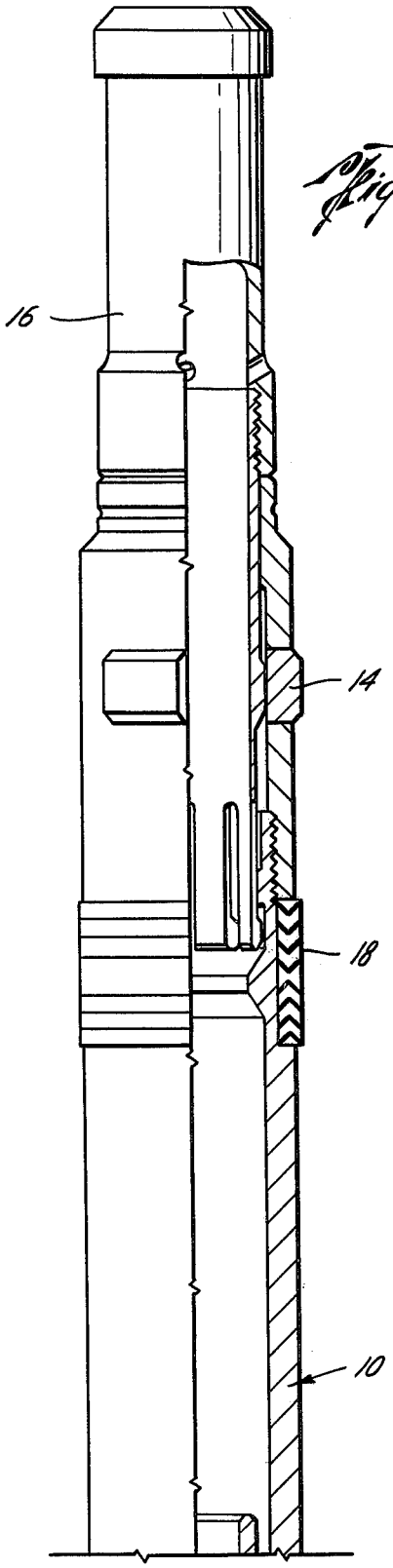
FIGS. 2A, 2B, 2C and 2D are continuations of each other of quarter sections taken along the lines 2A—2A, 2B—2B, 2C—2C, 2D—2D, respectively, of FIG. 1, showing the safety valve of the present invention in its normal open operating position.

Referring now to the drawings, and particularly to FIGS. 1 and 2A, the safety valve of the present invention is generally indicated by the reference numeral 10 and is adapted to be positioned in a well tubing 12 such as by being retrievably positioned in the bore of the well tubing 12 by retractible dogs 14 of a conventional well lock 16. The annulus between the safety valve 10 and the interior of the well tubing 12 is sealed by conventional seal 18.

The safety valve 10 generally includes an annular valve seat 20 (FIG. 2D) and a flapper valve member 22 connected to a valve body 24 by a pivot pin 26. Thus when the flapper 22 is in the upper position seated on the valve seat 20, the safety valve 10 is closed blocking flow upwardly through the bore 28. A tubular member generally indicated by the reference numeral 30 is telescopically movable in the body 24 and through the valve seat 20. When the tubular member 30 is moved to a downward position, the member 30 pushes the flapper valve member 22 away from the valve seat 20. The valve 10 is held in the open position so long as the tubular member 30 is in the downward position. When the tubular member 30 is moved upwardly, the flapper 22 is allowed to swing onto seat 20 by the action of a spring 32 and also by the action of fluid flow moving upwardly through the bore 28 of the body 24 closing the valve.

The tubular member 30 includes a plurality of telescoping sections such as a first upper section 34, a second middle section 36, and a third lower section 38. The valve 10 is shown in FIGS. 2A through 2D in its normal well producing position with a first releasable locking means generally indicated by the reference numeral 40 normally securing the first sections 34 and the second section 36 together while a second releasable locking means, generally indicated by the reference numeral 42 (FIG. 2C) normally secures the second section 36 and the third section 38 together.

Various forces may be provided to act on the sliding tubular member 30 to control its movement so that under normal well producing conditions the member 30 will be in a downward position holding the flapper 22 away of and off of the valve seat 20, but when either a predetermined high tubing pressure or a predetermined low tubing pressure occurs, the tubular member 30 will be actuated to allow the flapper 22 to close shutting off flow through the well tubing 12. Thus, yieldable urging means such as a pressurized chamber 44 (FIG. 2B) is provided between the member 30 and the body 24 and a piston 46 is secured to or is a part of section 34. Chamber 44 is pressurized through a dill valve 48 to a desired pressure and the pressure in the chamber 44 acts against the top of the piston 46 in a direction to move the tubular member 30 to open the flapper valve member 22. It is also to be noted that the piston 46 is exposed to fluid pressure in the valve body 24 in a direction to move the tubular member 30 upwardly in opposition to the pressurized chamber 44 and in a direction to allow the closure of valve 22.

Another force acting on the tubular member 30 is yieldably urging means such as spring means 50 (FIG. 2C) acting between the body 24 and the middle section 36 of the tubular member 30 for moving member 30 downwardly in a direction to open the valve element 22. Another force acting on the tubular member 30 is yieldable urging means such as a spring 52 acting between the body 24 and the third section 38 in a direction for moving the third section upwardly for allowing the flapper valve element 22 to close the valve.

The safety valve 10 is shown in its normal well producing valve open position in FIGS. 2A through 2D with the various forces acting on the tubular member 30 such as the pressurized chamber 42 acting on the piston 46 in a downwardly direction, the spring 50 acting on the section 36 of the tubular member 30 in a downwardly direction, the spring 52 acting on the section 38 of the tubular member 30 in an upwardly direction, and the fluid pressure in the tubing 12 acting on the bottom of the piston 46 in an upwardly direction to keep the tubular member 30 balanced between a predetermined high tubing pressure and a predetermined low tubing pressure.

Figures 2B, 2C, 2D:
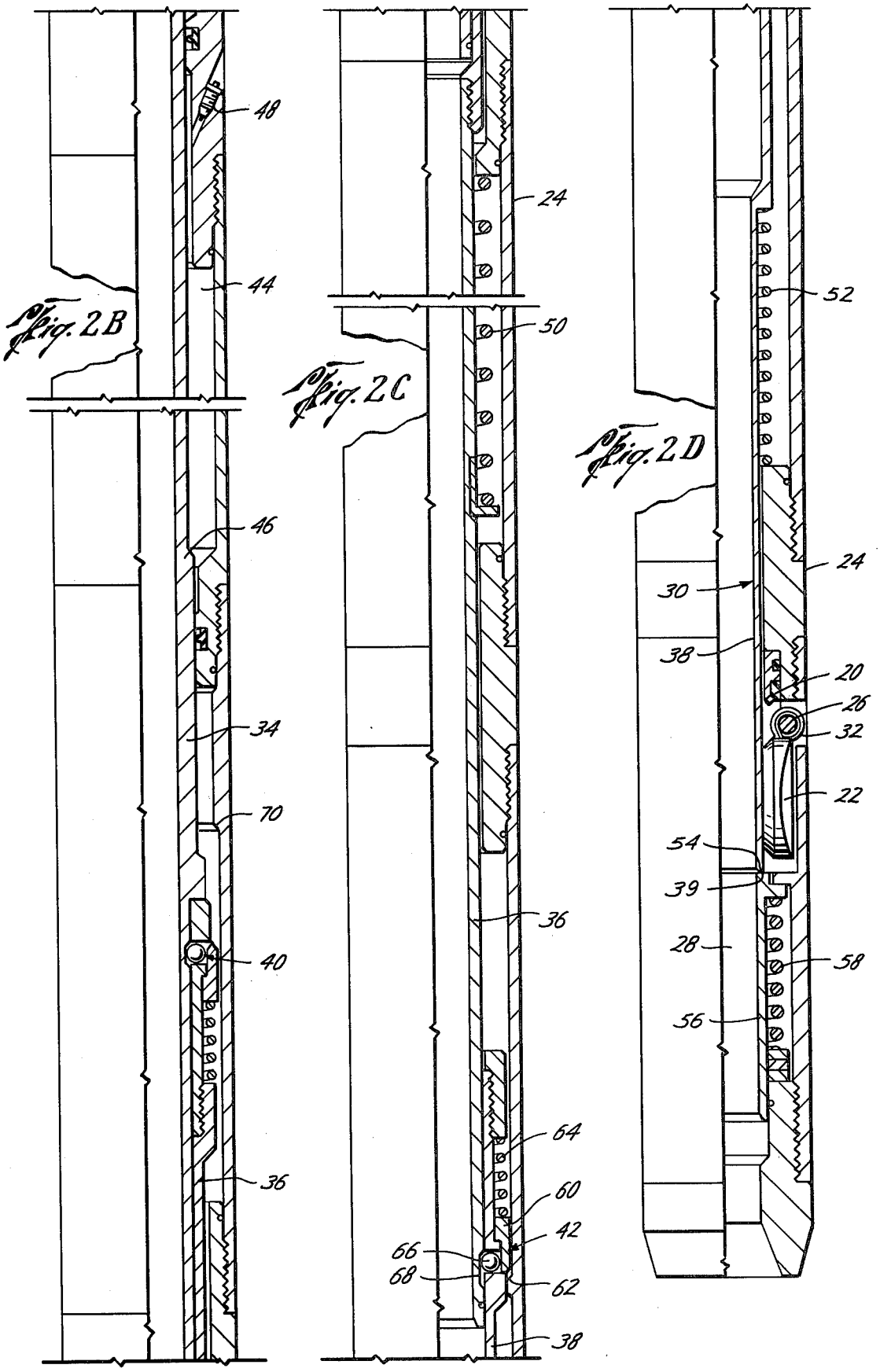
Figure 3:
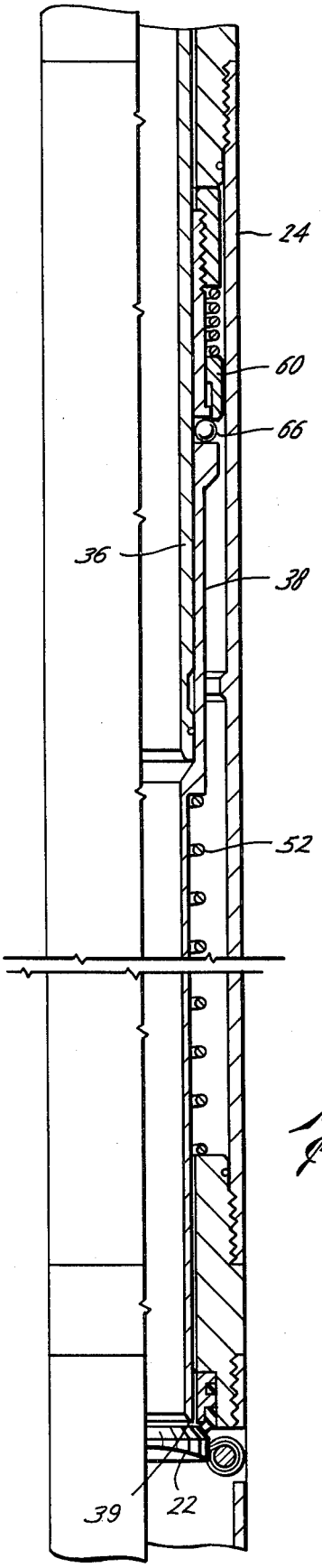
FIG.3 is a fragmentary quarter sectional elevational view showing the lower portion of the safety valve in the closed position after being actuated by low pressure.

Assume that the safety valve 10 is in its normal well producing position as illustrated in FIGS. 2A through 2D and the tubing pressure of the well fluid increases to an abnormal high pressure or a predetermined high pressure at which time the high fluid pressure acting against the bottom of piston 46 overcomes the downwardly acting pressure in chamber 44 and the downwardly acting force of spring 50 to move the interlocked tubular member 30 upwardly until the lower end 39 of the tubular member moves allowing the flapper valve member 22 to swing closed and shut off flow through the safety valve 10 (similar to the position indicated in FIG. 3 except that the sections 34, 36 and 38 of the tubular member 30 remain interlocked by locking means 40 and 42).

Next, the actuation of the valve to a closed position by low tubing pressure will be described. When the valve 10 is fully opened, as best seen in FIG. 2D, the bottom 39 of the lower tubular section 38 contacts and stops against a stop shoulder 54 of a movable sleeve 56. The sleeve 56 is yieldably urged upwardly by a spring 58 with a preset load of a predetermined magnitude. When a predetermined or abnormal low tubing pressure is encountered in the tubing 12, the section 38 of the tubular member 30 will move down, as will be described, and overcome the preset load in the spring 58 and allow further downward movement of the section 38. And the releasable locking means 42 between the tubing section 36 and the tubing section 38 will release allowing the spring 52 to move the lower third section 38 upwardly which allows the flapper valve member 22 to swing closed and shut off the safety valve 10 (FIG. 3).

For example, assume that the safety valve 10 is in its normal operating position with a normal tubing fluid pressure acting against the bottom of piston 46 as shown in FIGS. 2A–2D. In the event that the tubing pressure decreases, the force exerted by the tubing pressure on the bottom of piston 46 decreases causing the lower section 38 of the tubular member 30 to increasingly press against the shoulder 54 of the sleeve 56. When the tubuing pressure falls to a predetermined value, the tubular member 30 will press the section 38 downwardly to overcome the load in spring 58 causing the releasing locking means 42 between the tubing section 36 and the tubing section 38 to release. That is, as best seen in FIG. 2C, a ball sleeve 60 will contact a releasing shoulder 62 to overcome spring 64 while sections 36 and 38 continue to move downwardly and the locking balls 66 are allowed to move down and outwardly and disengage the locking groove 68 in the tubular section 36. At this time, the lower tubular section 38 is disengaged from the middle tubular section 36 and, as best seen in FIG. 3, spring 52 will move the lower section 38 upwardly allowing the flapper valve member 22 to swing closed and shut off the safety valve.

Figure 5:
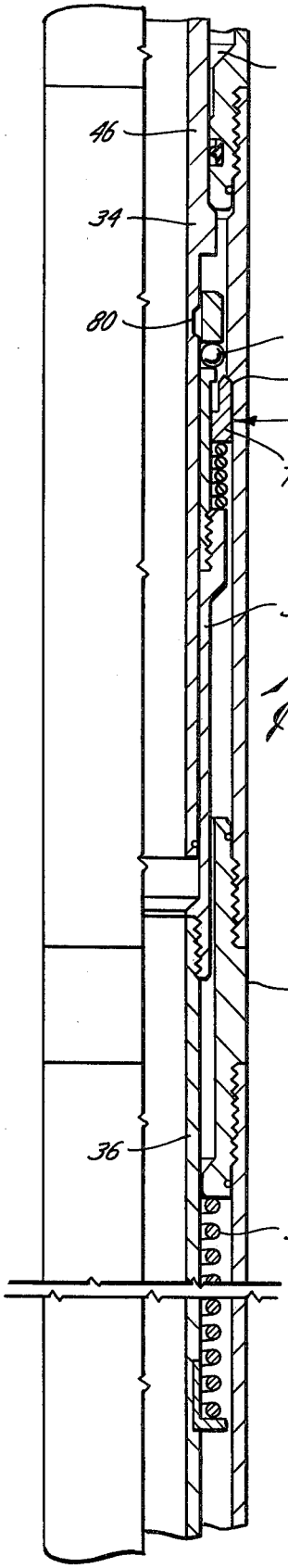
FIG. 5 is a fragmentary elevational view, in quarter section, illustrating a portion of the safety valve which is in the process of being reset after actuation.
Figure 6:
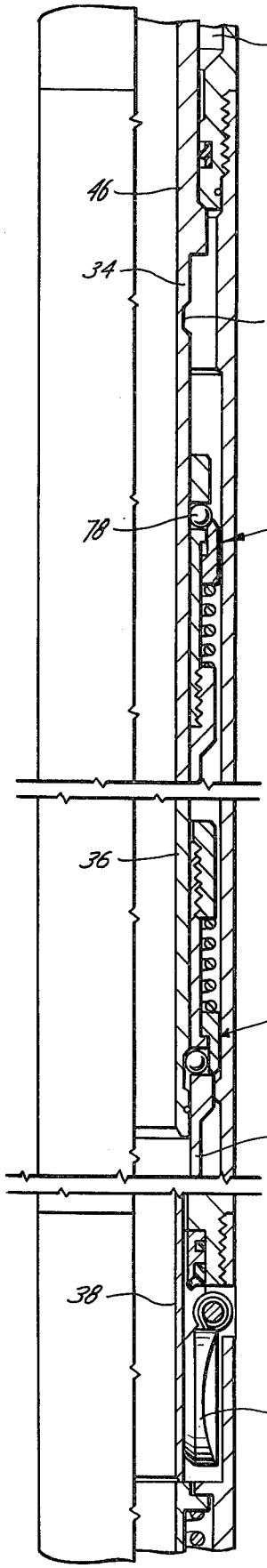
FIG. 6 is a fragmentary elevational view, in quarter section, illustrating a further step, after FIG. 5, in the process of resetting the valve of the present invention.

A safety valve 10 of the present invention, after being closed by an abnormal high or abnormal low tubing pressure, is resettable by suitably pressuring the well tubing 12 such as from the well surface or by equalizing across the valve. First, assume that the safety valve 10 has been actuated to a closed position, as previously described, with the interlocking sections 34, 36 and 38 being moved upwardly above the flapper valve 22 by high tubing pressure acting on the piston 46. With the valve 10 thus closed because of high tubing pressure, the valve 10 may be reset by actuating the valve by pressuring the valve as best seen in FIGS. 5 and 6. To reset the valve 10, after closing by high tubing pressure, the tubing pressure is increased to increase the force acting on the piston 46 to further overcome the downwardly reacting pressure in chamber 44 and the downwardly acting pressure of spring 50 to move the interlocked tubular member 30 upwardly until the first releasable locking means 40 contacts a releasing shoulder 74 (FIG. 5) thereby releasing the lock 40 between the first upper tubing section 34 and the second middle tubing section 36. That is, a ball sleeve 72 will contact the releasing shoulder 74 and overcome spring 76 and stop while allowing upper section 34 and middle section 36 to move upwardly and allow the locking balls 78 to move outwardly and disengage the locking groove 80 in the upper tubular section 34. When the upper tubular section 34 is released from the middle tubular section 36, the force of the high tubing pressure is released from the tubing section 36 and and spring 50 will now move the middle tubing section 36 as well as the lower tubing section 38 downwardly. As best seen in FIGS. 5 and 6, with the upper section 34 disconnected from middle section 36, the spring 50 will drive the middle section 36 and lower section 38 downwardly to open the flapper valve 22. At this point in the resetting process, section 34 is disconnected from section 36, but sections 36 and 38 are still locked together by locking means 42 as best seen in FIG. 36. The next step in resetting the safety valve is to reduce the applied tubing pressure thereby reducing the upward force applied to the piston 46 and allowing the pressurized chamber 44 to act on the piston 46 to move the tubing section 34 downwardly until the locking groove 80 in section 34 engages the locking balls 78 to reconnect section 34 to section 36 thereby placing the safety valve 10 in the operating position as best seen in FIGS. 2A through 2D.

Figure 4:
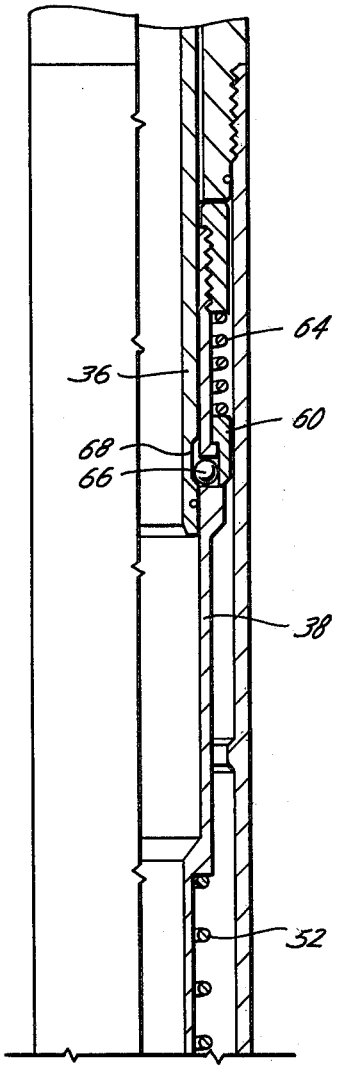
FIG. 4 is a fragmentary elevational view, in quarter section, of the closed valve of FIG. 3 in the process of being reset.

Next, assume that the safety valve 10 has been actuated to a closed position by an abnormal low tubing pressure. Thus, the valve is in the position shown in FIG. 3. To reset the valve 10 from its low tubing pressure tripped position, the tubing pressure in the tubing 12 is increased, such as from the well surface or from equalizing across the valve, and acts on the piston 46 of the upper tubular member 34 to move tubular sections 34 and 36 upwardly, and as best seen in FIG. 4, moves the middle tubular section 36 upwardly relatively to the lower tubular section 38 until the locking groove 68 moves upwardly sufficient to engage the locking balls 66 thereby again interlocking sections 36 and 38. The pressure in the well tubing 12 is then continued to be increased in the same manner as described in connection with FIGS. 5 and 6 to reset the valve 10. That is, the increased pressure moves the now interlocked sections 34, 36 and 38 upwardly until the releasable locking means 40 encounters shoulders 74 (FIG. 5) thereby releasing section 34 from section 36 and allowing spring 50 to move interlocked sections 34 and 36 downwardly to open flapper valve 22 as best seen in FIG. 6. The pressure in the well tubing 12 is then lowered for moving upper section 36 downwardly until the locking groove 80 engaged the locking balls 78 of the locking means 40 to reconnect the valve 10 in the operating position shown in FIGS. 2A through 2D.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts may be provided without departing from the spirit of the invention and the scope of the appended claims.

What is claimed is:

1. A well safety valve adapted to be positioned in a well tubing and close on either a predetermined high tubing pressure or a predetermined low tubing pressure comprising, a body, a valve closure member in the body moving between open and closed positions, a tubular member longitudinally movable in the body for controlling the movement of the valve closure member, said tubular member including a first upper, a second middle, and a third lower telescoping section, said first section including a piston exposed to fluid pressure in the tubing acting to move the first section in response to the fluid pressure, means yieldably urging the first section in a direction to open the valve, means yieldably urging the second section in a direction to open the valve, first releasable locking means normally securing the first and second sections together, second releasable locking means normally securing the second and third sections together, means for moving the third section in a direction for allowing the closure of the valve member when the second locking means is released.

2. The apparatus of claim 1 including, a movable stop shoulder in the path of movement of the third lower section for allowing the release of the second locking means.

3. The apparatus of claim 1 including, each of said releasable locking means being resettable, a releasing shoulder connected to the body and positioned in the path of movement of each locking means for releasing the locking means when the locking means contacts a releasing shoulder.

4. The apparatus of claim 2 including, means yieldably urging said stop shoulder towards said third section, but allowing movement of the third section with said stop shoulder for releasing said second locking means.

* * * * *